US005571654A

United States Patent [19]

Ong

[11] Patent Number: 5,571,654

[45] Date of Patent: Nov. 5, 1996

[54] TONER COMPOSITIONS WITH NEGATIVE CHARGE ENHANCING ADDITIVES

[75] Inventor: Beng S. Ong, Mississauga, Canada

[73] Assignee: Xerox Corporation, Stamford, Conn.

[21] Appl. No.: 523,577

[22] Filed: Sep. 5, 1995

[51] Int. Cl.[6] ..... G03G 9/097

[52] U.S. Cl. ..... 430/110

[58] Field of Search ..... 430/110

[56] References Cited

U.S. PATENT DOCUMENTS 5,188,929 2/1993 Ishii ..... 430/110
5,275,900 1/1994 Ong et al. ..... 430/110
5,300,387 4/1994 Ong ..... 430/110
5,302,481 4/1994 Ong ..... 430/106
5,409,794 4/1995 Ong ..... 430/110

*Primary Examiner*—Christopher D. Rodee
*Attorney, Agent, or Firm*—E. O. Palazzo

[57] ABSTRACT

A negatively charged toner composition comprised of toner resins, colorants, optional surface additives, and a metal charge enhancing additive obtained from the reaction of a metal ion with a molar equivalent of an ortho-hydroxyphenol and two molar equivalents of an aromatic carboxylic acid in an aqueous medium in the presence of a base.

23 Claims, No Drawings

TONER COMPOSITIONS WITH NEGATIVE CHARGE ENHANCING ADDITIVES

BACKGROUND OF THE INVENTION

This invention is generally directed to toner and developer compositions, and more specifically, the present invention is directed to developer and toner compositions containing charge enhancing additives, which impart or assist in imparting a negative charge to the toner particles and enable toners with rapid triboelectric charging characteristics. In embodiments, there are provided in accordance with the present invention negatively charged toner compositions comprised of toner resins, pigment particles or dye molecules, and certain metal charge enhancing additives. In another embodiment, the present invention is directed to toners with metal charge enhancing additives, which additives can be obtained, for example, from the reaction of a metal ion, such as aluminum or zinc ion with an ortho-hydroxyphenol, and an aromatic carboxylic acid in the presence of an appropriate base such as potassium hydroxide. The aforementioned charge additives in embodiments of the present invention enable, for example, toners with rapid triboelectric charging characteristics, extended developer life, stable triboelectrical properties irrespective of changes in environmental conditions, and high image print quality with substantially no background deposits. Also, the aforementioned toner compositions usually contain a colorant component comprised of, for example, color pigments or dyes, such as black, cyan, magenta, yellow, blue, green, red, or brown color, or mixtures thereof, thereby providing for the development and generation of black and/or colored images. The toner and developer compositions of the present invention can be selected for electrophotographic, especially xerographic, imaging and printing processes, including color and digital processes.

Toners with negative charge enhancing additives are known, reference for example U.S. Pat. Nos. 4,411,974 and 4,206,064, the disclosures of which are totally incorporated herein by reference. The '974 patent discloses negatively charged toner compositions comprised of toner resins, pigment particles, and as a charge enhancing additive ortho-halophenyl carboxylic acids. Similarly, there are disclosed in the '064 patent toner compositions with chromium, cobalt, and nickel complexes of salicylic acid as negative charge enhancing additives. In U.S. Pat. No. 4,845,003, there are illustrated negatively charged toners with certain aluminum salt charge additives. More specifically, this patent discloses as charge additives aluminum complexes comprising of two or three hydroxybenzoic acid ligands bonded to a central aluminum ion. While these charge additives may have the capability of imparting negative triboelectric charge to toner particles, they are generally not efficient in promoting the rate of triboelectric charging of toner particles. A fast rate of triboelectric charging is particularly crucial for high speed xerographic machines since, for example, these machines consume toner rapidly, and fresh toner has to be constantly added. The added uncharged toners, therefore, must charge up to their equilibrium triboelectric charge level rapidly to ensure no interruption in the xerographic imaging or printing operation. Another shortcoming of these charge additives is their thermal instability, that is they often break down during the thermal extrusion process of the toner manufacturing cycle. Most or many of these and other disadvantages are eliminated, or substantially eliminated with the metal complex charge additives of the present invention.

Toner compositions with other negative charge enhancing additives include, for example, those described in U.S. Pat. Nos. 5,300,387 and 5,302,481, the disclosures of which are totally incorporated herein by reference. Specifically, the '387 patent discloses toner compositions comprised of a toner resin, a colorant, optional surface additives and a metal complex charge additive derived from the reaction of a dicarboxylic acid and a hydroxybenzoic acid with a metal ion. Structurally, these charge enhancing additives are anionic metal complexes containing an anion comprised of a central metal ion, such as aluminum, gallium, zinc, cobalt ion and the like, bonded to two different bidentate ligands derived from an aromatic dicarboxylic acid and a hydroxybenzoic acid, and a countercation of proton, ammonium ion, alkaline metal cation or the like. Similarly, the '481 patent describes toner compositions with aluminum charge additives with mixed ligands derived from hydroxyphenol and hydroxybenzoic acid. While these charge additives are effective in imparting negative charge to toners, their rates of charging are generally in many instances not as rapid as those of the additives of the present invention, and their preparative processes are not as simple as the preparation of the charge additives of the present invention. Another advantage of the charge additives of the present invention is that they can be obtained from economical precursors. There are also disclosed in U.S. Pat. No. 5,409,794, the disclosure of which is totally incorporated herein by reference, toner compositions containing negative charge additives derived from the reaction of a metal, a metal carbonyl, a metal salt, or a metal oxide with a β-diketone, a β-keto ester, or a malonic ester in an aqueous or organic medium. These charge additives render toner compositions negative in triboelectric charging, but their charging rates are generally slower than those of the charge additives of the present invention.

Developer compositions with charge enhancing additives, which impart a positive charge to the toner particles, are also well known. Thus, for example, there is described in U.S. Pat. No. 3,893,935 the use of quaternary ammonium salts as charge control agents for electrostatic toner compositions; U.S. Pat. No. 4,221,856 which discloses electrophotographic toners containing resin compatible quaternary ammonium compounds; U.S. Pat. No. 4,338,390, the disclosure of which is totally incorporated herein by reference, illustrates developer compositions containing as charge enhancing additives organic sulfate and sulfonates, which additives can impart a positive charge to the toner composition; and U.S. Pat. No. 4,298,672, the disclosure of which is totally incorporated herein by reference, illustrates positively charged toner compositions with resins and pigment particles, and as charge enhancing additives alkyl pyridinium compounds.

Illustrated in U.S. Pat. No. 5,391,453 is a negatively charged toner composition comprised of resin, pigment or dye particles, optional surface additives, and an aluminum complex composite charge additive containing active charge enhancing components as represented by the following formulas

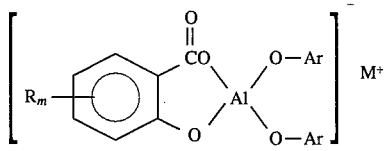

(I)

-continued

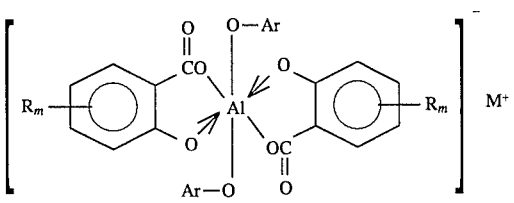

(II)

wherein R is a hydrogen, halogen, alkyl, aryl, alkoxy, aryloxy, hydroxy, nitro, or an amino substituent; Ar represent an aromatic group; M + is a proton, an alkaline metal cation, or an ammonium ion; and m is a number of from 1 to about 3; and in U.S. Pat. No. 5,332,636 there is illustrated a negatively charged toner composition comprised of resin or resins, pigment particles, optional surface additives, and an aluminum charge enhancing additive represented by the following formula

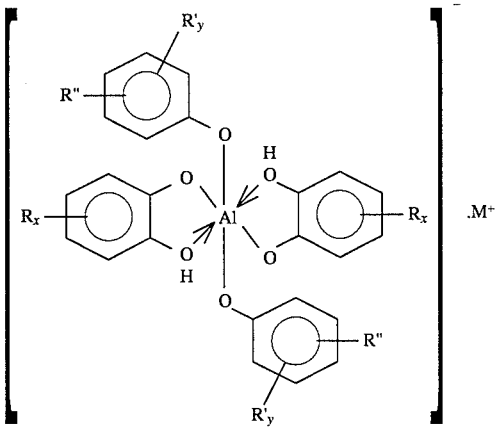

wherein R and R' are independently selected from the group consisting of hydrogen, alkyl, aryl, alkoxy, aryloxy, hydroxy, halogen, amino, cyano, and nitro; R" is hydrogen or hydroxy; M + is a countercation comprised of a proton, an ammonium ion, a substituted ammonium ion or a metal cation; and x and y are the numbers 1 or 2, the disclosures of which are totally incorporated herein by reference.

In U.S. Pat. No. 5,256,515 is a negatively charged toner composition comprised of resin particles, pigment particles, optional surface additives, and a halogenated salicylic acid complex charge enhancing additive of the following formula

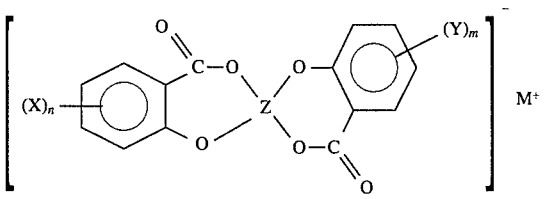

wherein Z is zinc or chromium; M is hydrogen, an alkali metal, an alkaline earth metal, $NH_4$, or $NR_4$ wherein R is alkyl; X and Y are independently selected from the group consisting of chloride, iodide and bromide; and n and m are the numbers 1 or 2; in U.S. Pat. No. 5,256,5 is a negatively charged toner composition comprised of resin particles, pigment particles, optional surface additives, and a halogenated salicylic acid charge enhancing additive of the following formula

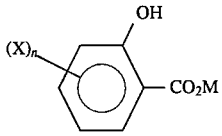

wherein X is halogen, M is hydrogen, an alkaline earth, an alkali metal, or $NR_4$ wherein R is alkyl, and n is the number 1 or 2; and in U.S. Pat. No. 5,300,389 is a negatively charged toner composition comprised of resin particles, pigment particles, optional surface additives, and a halogenated aluminum salicylic acid complex charge enhancing additive of the following formulas

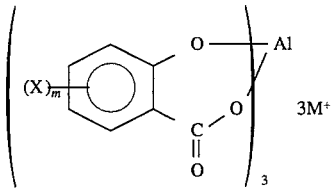

or

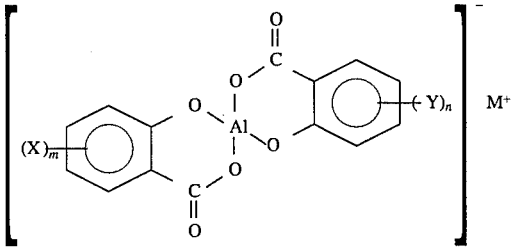

wherein M is hydrogen, an alkali metal, an alkaline earth metal, $NH_4$, or $NR_4$ wherein R is alkyl; X and Y are independently selected from the group consisting of iodide, chloride and bromide, and n and m are the numbers 1 or 2, the disclosures of which are totally incorporated herein by reference.

Although many charge enhancing additives are known, there continues to be a need for charge enhancing additives which provide toners with many of the advantages illustrated herein. There is also a need for negative charge enhancing additives which are useful for incorporation into black and colored toner compositions which can be utilized for developing positive electrostatic latent images. Moreover, there is a need for colored toner compositions containing charge enhancing additives which do not interfere with the color quality of the colorants present in the toners. Another need relates to the provision of toner compositions with certain charge enhancing additives, which toners in embodiments thereof possess substantially stable triboelectric charge levels, and display acceptable rates of triboelectric charging characteristics. Furthermore, there is also a need for toner compositions with certain charge enhancing additives based on aluminum complexes with both salicylate and catechol ligands, which possess excellent dispersibility characteristics in toner resins, and can, therefore, form stable dispersions in the toner compositions. There is also a need for negatively charged black and colored toner compositions that are useful for incorporation into various imaging processes, inclusive of color xerography, as illustrated in U.S. Pat. No. 4,078,929, the disclosure of which is totally incorporated herein by reference; laser printers; and additionally a need for toner compositions useful in imaging apparatuses having incorporated therein layered photoresponsive imaging members, such as the members illustrated in U.S. Pat. No. 4,265,990, the disclosure of which is totally incorporated herein by reference. Also, there is a need for negative toner compositions which have desirable triboelectric charge levels of, for example, from between about −10 to about −40 microcoulombs per gram, and triboelectric charging rates of less than about 120 seconds, and preferably less than 60 seconds, for example from about 15 to about 30 seconds, as measured by standard charge spectrograph methods when the toners are frictionally charged against suitable carrier particles via roll milling. There is also a need for nontoxic, substantially nontoxic, or environmentally compatible charge enhancing additives, which when incorporated at effective concentrations of, for example, less than 7 weight percent, preferably less than 5 weight percent in toners, render the toners to be environmentally friendly. An additional need resides in the provision of simple and cost-effective preparative processes for the aluminum complex charge enhancing additives of the present invention. The concentrations of the charge additives that can be incorporated into the toner compositions generally range from about 0.05 weight percent to about 5 weight percent, depending on whether the charge additive is utilized as a surface additive or as a dispersion in the bulk of the toner. The effective concentrations of toner in the developer, that is toner and carrier particles, are, for example, from about 0.5 to about 5 weight percent, preferably from about 1 to about 3 weight percent.

Illustrated in U.S. Pat. No. 5,438,829 is a negatively charged toner composition comprised of a polymer resin or polymer resins, colorants comprised of pigment particles and/or dyes, optional surface additives, and a boron charge enhancing additive obtained from the reaction of an alkylboric acid or an arylboric acid and an N-alkyl-or N-aryl-substituted bis(hydroxyalkyl)amine, or a zinc charge enhancing additive obtained from the reaction of an aromatic carboxylic acid and an N-alkyl- or N-aryl-substituted bis(hydroxyalkyl)amine with a zinc ion-containing compound in aqueous medium; and U.S. Pat. No. 5,532,098 is a toner composition comprised of toner resins, colorants, optional surface additives, and a charge enhancing additive obtained from the reaction of an aluminum ion-containing compound with a molar equivalent of an aromatic carboxylic acid, and an excess of an N-alkyl or N-aryl-substituted bis(hydroxyalkyl)amine in an aqueous medium at a temperature ranging from about 25° C. to about 100° C., the disclosures of which are totally incorporated herein by reference.

SUMMARY OF THE INVENTION

Examples of objects of the present invention include:

It is an object of the present invention to provide toner and developer compositions with negative charge enhancing additives.

In another object of the present invention there are provided negatively charged toner compositions useful for the development of electrostatic latent images including color images.

In yet a further object of the present invention there may be provided, it is believed, humidity insensitive or substantially humidity insensitive, from about, for example, 2 0 to about 80 percent relative humidity at temperatures of from 60° to 80° F. as determined in a relative humidity testing chamber, negatively charged toner compositions with desirable triboelectric charging rates of less than 60 seconds as determined by the charge spectrograph method, and acceptable triboelectric charging levels of from about −10 to about −40 microcoulombs per gram.

Another object of the present invention resides in the preparation of negatively charged toners which will enable the development of images in electrophotographic imaging apparatuses, which images have substantially no background deposits thereon, are substantially smudge proof or smudge resistant, and, therefore, are of excellent resolution; and which toner compositions can be selected for high speed electrophotographic apparatuses, that is, for example, those exceeding 50, and for example from 50 to 120 copies per minute.

A further object is to provide a simple and cost-effective process for the metal charge enhancing additives by the treatment of an aqueous solution of aluminum sulfate with one molar equivalent of an ortho-hydroxyphenyl and two molar equivalents of an aromatic carboxylic acid in the presence of an appropriate base such as potassium hydroxide.

These and other objects of the present invention may be accomplished in embodiments thereof by providing toner compositions comprised of toner resins, or resin particles, colorants comprised of color pigments or dye molecules, and certain metal charge enhancing additives which are obtained from the reaction of a metal ion with one molar equivalent of ortho-hydroxyphenol and two molar equivalents of an aromatic carboxylic acid in an aqueous medium in the presence of an appropriate base such as potassium hydroxide. More specifically, the present invention in embodiments is directed to toner compositions comprised of thermoplastic resin, pigment, and a negative charge enhancing additive represented by formula (I)

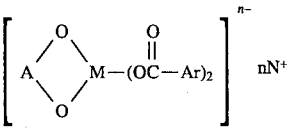

(I)

wherein M is a divalent or trivalent metal such as Al, or Zn; A is an aromatic moiety or aryl of from 6 to about 30 carbon atoms, such as phenyl; Ar is an aromatic or aryl group of from 6 to about 30 carbon atoms, such as phenyl; N+ is the countercation, such as alkaline cation including K+, Na+, Cs+ and the like, and the ammonium ion; and n is the number 1 or 2; or wherein N+ is $R_3NH$, $R_2NH_2$, $RNH_3$ or $RNH_4$, wherein R is alkyl with, for example, 1 to about 25 carbon atoms. More specifically, aryl is a phenylene or alkyl phenylene.

The aforementioned charge enhancing additives can be incorporated into the toner, may be present on the toner surface, or may be present on the toner's surface additives such as colloidal silica particles. Advantages of rapid triboelectric charging characteristics of generally less than 120 seconds, and specifically less than 60 seconds, such as from 15 to about 30 seconds, in embodiments as measured by the standard charge spectrograph methods when the toners are frictionally charged against carrier particles via roll mixing methods, appropriate triboelectric charge levels, and the like can be achieved with many of the aforementioned toners of the present invention. In another embodiment of the present invention, there are provided, subsequent to known micronization and classification, toner particles with a volume average diameter of from about 3 to about 20 microns.

In embodiments, the present invention is directed to a negatively charged toner composition comprised of toner resins, colorants, optional surface additives, and a metal charge enhancing additive obtained from the reaction of a metal ion with a molar equivalent of an ortho-hydroxyphenol and two molar equivalents of an aromatic carboxylic acid in an aqueous medium in the presence of a base; and a negatively charged toner composition comprised of thermoplastic resins, colorants, optional surface additives, and a metal charge enhancing additive of the formula (I).

The toner compositions of the present invention can be prepared by a number of known methods, such as admixing and heating polymer resins such as styrene butadiene copolymers, colorants such as color pigments or dye compounds, and the aforementioned metal charge enhancing additive, or mixtures of charge additives in a concentration, preferably ranging from about 0.5 percent to about 5 percent, in a toner extrusion device, such as the ZSK53 available from Werner Pfleiderer, and removing the resulting toner composition from the device. Subsequent to cooling, the toner composition is subjected to grinding utilizing, for example, a Sturtevant micronizer for the purpose of achieving toner particles with a volume average diameter of from about 2 to about 15 microns, and preferably from about 3 to about 12 microns, which diameters are determined by a Coulter Counter. Subsequently, the toner compositions can be classified utilizing, for example, a Donaldson Model B classifier for the purpose of removing unwanted fine toner particles.

Illustrative examples of suitable resins or resin particles selected for the toner and developer compositions of the present invention include thermoplastics, such as vinyl polymers such as styrene polymers, acrylonitrile polymers, vinyl ether polymers, acrylate and methacrylate polymers; epoxy polymers; polyurethanes; polyamides and polyimides; polyesters; and the like. The toner resins selected for the toner compositions of the present invention include homopolymers or copolymers of two or more monomers. Furthermore, the above-mentioned polymer resins may also be crosslinked depending on the toner properties desired. Illustrative vinyl monomer units in the vinyl polymers include styrene, substituted styrenes such as methyl styrene, chlorostyrene, methyl acrylate and methacrylate, ethyl acrylate and methacrylate, propyl acrylate and methacrylate, butyl acrylate and methacrylate, pentyl acrylate and methacrylate, butadiene, vinyl chloride, acrylonitrile, acrylamide, alkyl vinyl ether and the like. Illustrative examples of the dicarboxylic acid units in the polyester resins suitable for use in the toner compositions of the present invention include phthalic acid, terephthalic acid, isophthalic acid, succinic acid, glutaric acid, adipic acid, pimelic acid, suberic acid, azelaic acid, sebacic acid, maleic acid, fumaric acid, dimethyl glutaric acid, bromoadipic acids, dichloroglutaric acids, and the like; while illustrative examples of the diol units in the polyester resins include ethanediol, propanediols, butanediols, pentanediols, pinacol, cyclopentanediols, hydrobenzoin, bis(hydroxyphenyl)alkanes, dihydroxybiphenyl, substituted dihydroxybiphenyls, and the like.

As one toner resin, there are selected polyester resins derived from a dicarboxylic acid and a diphenol. These resins, which are illustrated in U.S. Pat. No. 3,590,000, the disclosure of which is totally incorporated herein by reference, include polyester resins obtained from the reaction of bisphenol A and propylene oxide, followed by the reaction of the resulting product with fumaric acid, and branched polyester resins resulting from the reaction of dimethylterephthalate with 1,3-butanediol, 1,2-propanediol, and pentanetriol. Further, low melting polyesters, especially those prepared by reactive extrusion, reference U.S. Pat. No. 5,376,494 and U.S. Pat. No. 5,227,460, the disclosures of which are totally incorporated herein by reference, can be selected as toner resins. Other specific toner resins include styrene-methacrylate copolymers, and styrene-butadiene copolymers; PLIOLITES™, a styrene butadiene available from Goodyear Chemical; and suspension polymerized styrene-butadienes, reference U.S. Pat. No. 4,558,108, the disclosure of which is totally incorporated herein by reference. Also, waxes with a molecular weight of from about 1,000 to about 20,000, and preferably from 1,000 to about 7,000, such as polyethylene, polypropylene, and paraffin waxes, can be included in, or on the toner compositions as fuser roll release agents.

The toner resins are present in a sufficient, but effective amount, for example from about 40 to about 95 weight percent. Thus, when 1 percent by weight of the charge enhancing additive is present, and 10 percent by weight of colorant, such as carbon black or color pigment, is contained therein, about 89 percent by weight of toner resin is selected. Also, the charge enhancing additive of the present invention may be applied as a surface coating on the toner particles. When used as a coating, the charge enhancing additive of the present invention is present in an amount of from about 0.05 weight percent to about 5 weight percent, and preferably from about 0.1 weight percent to about 1.0 weight percent. Generally, the charge additive is present in an amount of from about 0.05 to about 10, and preferably from about 1 to about 5 weight percent based on the weight of the toner of toner resin, pigment, and charge additive.

Numerous well known suitable color pigments or dyes can be selected as the colorant for the toner compositions including, for example, carbon black like REGAL 330®, nigrosine dye, metal phthalocyanines, aniline blue, magnetite, or mixtures thereof. The colorant, which is preferably carbon black or other color pigments, should be present in a sufficient amount to render the toner composition with a sufficiently high color intensity. Generally, the colorants are present in amounts of from about 1 weight percent to about 20 weight percent, and preferably from about 2 to about 10 weight percent based on the total weight of the toner composition; however, lesser or greater amounts of colorant can be selected.

When the colorants are comprised of magnetites or a mixture of magnetites and color pigment particles, thereby enabling single component toners and toners for magnetic ink character recognition (MICR) applications in some instances, which magnetites are a mixture of iron oxides ($FeO.Fe_2O_3$)including those commercially available as MAPICO BLACK®, they are present in the toner composition in an amount of from about 5 weight percent to about 70 weight percent, and preferably in an amount of from about 10 weight percent to about 50 weight percent. Mixtures of carbon black and magnetite with from about 1 to about 15 weight percent of carbon black, and preferably from about 2 to about 6 weight percent of carbon black, and magnetite, such as MAPICO BLACK®, in an amount of, for example, from about 5 to about 70, and preferably from about 10 to about 50 weight percent can be selected for black toner compositions of the present invention.

There can also be blended with the toner compositions of the present invention external additives including flow aid additives, which additives are usually present on the surface thereof. Examples of these additives include colloidal silicas, such as AEROSIL®, metal salts, metal oxides, and metal salts of fatty acids inclusive of zinc stearate, aluminum oxides, cerium oxides, titanium oxides, and mixtures thereof, which additives are generally present in an amount of from about 0.1 percent by weight to about 5 percent by weight, and preferably in an amount of from about 0.5 percent by weight to about 2 percent by weight. Several of the aforementioned additives are illustrated in U.S. Pat. No. 3,590,000 and 3,800,588, the disclosures of which are totally incorporated herein by reference.

With further respect to the present invention, colloidal silicas, such as AEROSIL®, can be surface treated with the aluminum complex charge enhancing additives of the present invention illustrated herein in an amount of from about 1 to about 50 weight percent and preferably 10 weight percent to about 25 weight percent, followed by the addition thereof to the toners in an amount of from 0.1 to 10, and preferably 0.1 to 5 weight percent.

Also, there can be included in the toner compositions of the present invention low molecular weight waxes, such as polypropylenes and polyethylenes commercially available from Allied Chemical and Petrolite Corporation, EPOLENE N-15™ commercially available from Eastman Chemical Products, Inc., VISCOL 550-P™, a low weight average molecular weight polypropylene available from Sanyo Kasei K. K., and the like. The commercially available polyethylenes selected have a molecular weight of from about 1,000 to about 1,500, while the commercially available polypropylenes utilized for the toner compositions of the present invention are believed to have a molecular weight of from about 4,000 to about 7,000. Many of the polyethylene and polypropylene compositions useful in the present invention are illustrated in British Patent No. 1,442,835. the disclosure of which is totally incorporated herein by reference. These low molecular weight wax materials are present in the toner composition of the present invention in various amounts, however, generally these waxes are present in the toner composition in an amount of from about 1 percent by weight to about 15 percent by weight, and preferably in an amount of from about 2 weight percent to about 10 weight percent.

Encompassed within the scope of the present invention are colored toner and developer compositions comprised of toner resins, optional carrier particles, the charge enhancing additives illustrated herein, and as colorants red, blue, green, brown, magenta, cyan and/or yellow dyes or color pigments, as well as mixtures thereof. More specifically, with regard to the generation of color images utilizing a developer composition with the charge enhancing additives of the present invention, illustrative examples of magenta materials that may be selected as colorants include, for example, 2,9-dimethyl-substituted quinacridone and anthraquinone dye identified in the Color Index as Cl 60710, Cl Dispersed Red 15. diazo dye identified in the Color Index as Cl 26050, Cl Solvent Red 19, and the like. Illustrative examples of cyan materials that may be used as colorants include copper phthalocyanine, x-copper phthalocyanine pigment listed in the Color Index as Cl 74160, Cl Pigment Blue, and Anthrathrene Blue, identified in the Color Index as Cl 69810, Special Blue X-2137, and the like; while illustrative examples of yellow pigments that may be selected are diarylide yellow 3,3-dichlorobenzidene acetoacetanilides, a monoazo pigment identified in the Color Index as Cl 12700, Cl Solvent Yellow 16, a nitrophenyl amine sulfonamide identified in the Color Index as Foron Yellow SE/GLN, Cl Dispersed Yellow 33, 2,5-dimethoxy-4-sulfonanilide phenylazo-4'-chloro-2,5-dimethoxy acetoacetanilide, and Permanent Yellow FGL. The aforementioned colorants are incorporated into the toner composition in various suitable effective amounts providing the objectives of the present invention are achieved. In one embodiment, these colorants are present in the toner composition in an amount of from about 1 percent by weight to about 15 percent by weight based on the total weight of the toner.

For the formulation of developer compositions, there are mixed with the toner particles carrier components, particularly those that are capable of triboelectrically assuming an opposite polarity to that of the toner composition. Accordingly, the carrier particles of the present invention are selected to be those that would render the toner particles negatively charged while acquiring a positive charge polarity themselves via frictional charging against the toner particles of the present invention. The opposite charge polarities of the carrier and toner particles of the developer composition thus ensure the toner particles to adhere to and surround the carrier particles. Illustrative examples of carrier particles include iron powder, steel, nickel, iron, ferrites, including copper zinc ferrites, nickel zinc ferrites, and the like. Additionally, there can be selected as carrier particles nickel berry carriers as illustrated in U.S. Pat. No. 3,847,604, the disclosure of which is totally incorporated herein by reference. The selected carrier particles can be used with or without a coating, the coating generally containing terpolymers of styrene, methylmethacrylate, and a silane, such as triethoxysilane, reference U.S. Pat. Nos. 3,526,533 and 3,467,634, the disclosures of which are totally incorporated herein by reference; polymethyl methacrylates; other known coatings; and the like. The carrier particles may also include in the coating, which coating can be present in one embodiment in an amount of from about 0.1 to about 3 weight percent, conductive substances such as carbon black in an amount of from about 5 to about 30 percent by weight. Polymer coatings not in close proximity in the triboelectric series can also be selected, reference U.S. Pat. Nos. 4,937,166 and 4,935,326, the disclosures of which are totally incorporated herein by reference, including for example KYNAR® and polymethylmethacrylate mixtures (40/60). Coating weights can vary as indicated herein; generally, however, from about 0.3 to about 2, and preferably from about 0.5 to about 1.5 weight percent coating weight is selected.

Furthermore, the diameter of the carrier particles, preferably spherical in shape, is generally from about 20 microns to about 500 microns, and preferably from between about 40 and 150 microns in volume average diameter thereby permitting them, for example, to possess sufficient density and inertia to avoid adherence to the electrostatic images during the development process. The carrier component can be mixed with the toner composition in various suitable combinations, such as about 1 to 5 parts of toner to about 100 parts to about 200 parts by weight of carrier.

The toner composition of the present invention can be prepared by a number of known methods as indicated herein, including extrusion melt blending the toner resins, colorants, and the metal complex charge enhancing additive of the present invention as indicated herein, followed by mechanical attrition and classification. Other methods include those well known in the art such as spray drying, melt dispersion, extrusion processing, dispersion polymerization, and suspension polymerization. Also, as indicated herein the toner composition without the charge enhancing additive can be first prepared, followed by addition of the charge enhancing additives and other optional surface additives, or the charge enhancing additive-treated surface additives such as colloidal silicas. Further, other methods of preparation for the toner are as illustrated herein. The toners of the present invention are usually jetted and classified subsequent to preparation to enable toner particles with a preferred volume average diameter of from about 3 to about 20 microns, and more preferably from about 3 to about 12 microns. The triboelectric charging rates for the toners of the present invention are preferably less than 120 seconds and, more specifically, from about 30 to about 60 seconds in embodiments thereof as determined by the known charge spectrograph method. These toner compositions with rapid rates of triboelectric charging characteristics enable, for example, the development of images in electrophotographic imaging apparatuses, which images have substantially no background deposits thereon, even at high toner dispensing rates in some instances, for instance exceeding 20 grams per minute; and further, such toner compositions can be selected for high speed electrophotographic apparatuses, that is those exceeding 50 copies per minute.

The toner and developer compositions of the present invention may be selected for use in electrostatographic imaging apparatuses containing therein photoreceptors, such as those illustrated in U.S. Pat. No. 4,265,990, the disclosure of which is totally incorporated herein by reference, providing that they, for example, are capable of forming positive electrostatic latent images relative to the triboelectric charge polarity of the toners.

Examples of specific charge additives of the present invention include the additives (II) through (X), wherein Ph is phenyl, and ᵗBu is tertiary butyl.

(II)

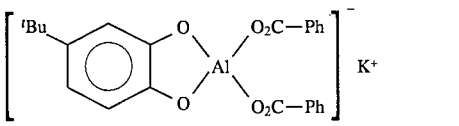

(III)

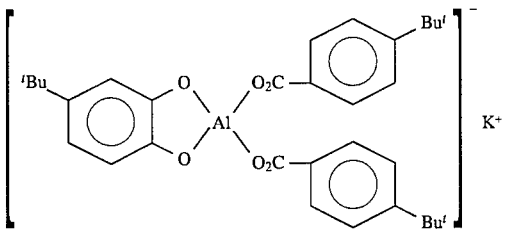

(IV)

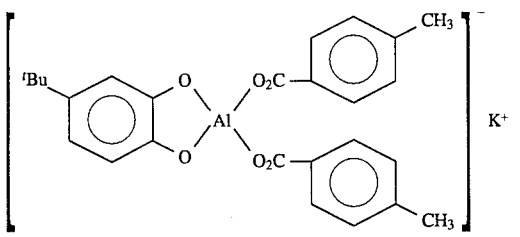

(V)

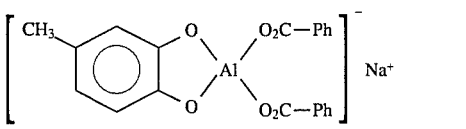

(VI)

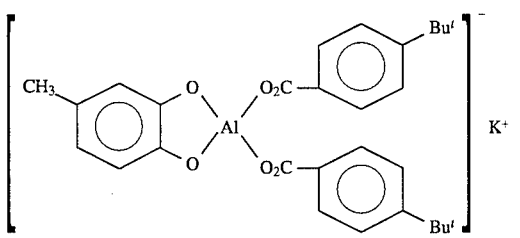

-continued (VII)

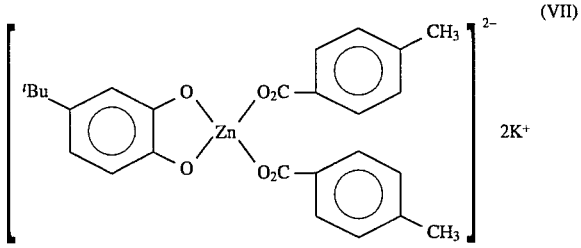

(VIII)

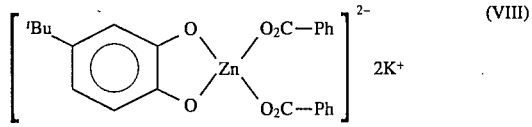

(IX)

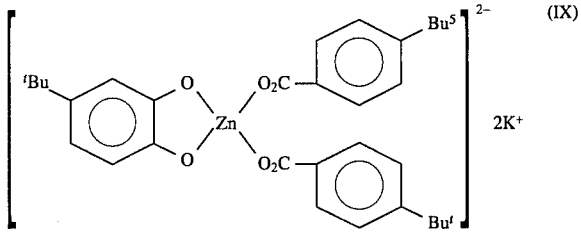

(X)

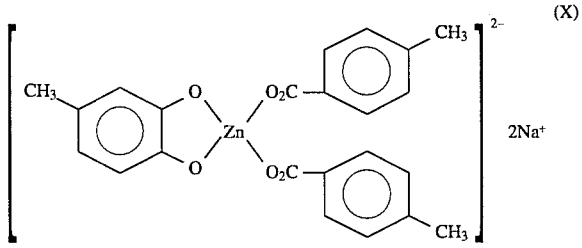

The following Examples are being supplied to further illustrate various embodiments of the present invention, it being noted that these Examples are intended to illustrate and not limit the scope of the present invention. Comparative Examples are also presented.

EXAMPLE I

The following procedure illustrates the preparation of the aluminum charge enhancing additive (II).

A mixture of 8.50 grams (12.5 millimoles) of aluminum sulfate octadecahydrate [$Al_2(SO_4)_3 \cdot 18H_{20}O$ ] and 4.15 grams (25.0 millimoles) of 4-tert-butylcatechol in 150 milliliters of water in a 1 liter round-bottomed flask fitted with a water condenser was mechanically stirred and heated to 90° C. under an argon atmosphere. A solution of 7.26 grams (110 millimoles) of 85 percent potassium hydroxide and 6.71 grams (55.0 millimoles) of benzoic acid in 100 milliliters of water was then added dropwise over a period of about 30 minutes. The temperature of the reaction mixture was maintained at about 80° C. to 90° C. during addition. After the addition, the reaction mixture was stirred at the same temperature, 80° C. to 90° C., for another 1 hour, and the pH of the reaction medium was maintained at above 8 with aqueous potassium hydroxide solution. After stirring for another 30 minutes, the reaction mixture was cooled down to about 40° C. and filtered. The filtered precipitate was washed with 100 milliliters of dilute aqueous potassium hydroxide solution (0.5 gram/liter of KOH), and dried in vacuo at 75° C. for 36 hours. The yield of the aluminum charge additive was 83 percent.

EXAMPLE II

The aluminum charge additive (III) was prepared in accordance with the procedure of Example I by replacing benzoic acid with 4-tert-butylbenzoic acid. The yield of the complex was 87 percent.

EXAMPLE III

The zinc charge additive (IX) was prepared in accordance with the procedure of Example I by substituting aluminum sulfate, 4-tert-butylcatechol and benzoic acid with zinc sulfate, 4-methylcatechol, and 4-methylbenzoic acid, respectively. The yield of the complex was 89 percent.

EXAMPLE IV

There was prepared in an extrusion device, available as ZSK-30 from Werner Pfleiderer, a toner composition by adding thereto 94.0 weight percent of a suspension polymerized styrene butadiene resin, reference U.S. Pat. No. 4,558,108, the disclosure of which is totally incorporated herein by reference; and 6.0 weight percent of REGAL 330® carbon black. The toner composition was extruded at a rate of 20 pounds per hour at a temperature of about 130° C. with a screw speed of 200 rpm. The strands of melt mixed product exiting from the extruder were air cooled, pelletized in a Berlyn Pelletizer and then fitzmilled in a Model J Fitzmill. The toner product was then subjected to grinding in a Sturtevant micronizer. Thereafter, the aforementioned toner particles were classified in a Donaldson Model B classifier for the purpose of removing fine particles, that is those with a volume average diameter of less than 4 microns. The resulting toner had a volume average particle diameter of 10.6 microns, and a particle size distribution of 1.22 as measured by a Coulter Counter. Subsequently, the toner obtained was surface coated with 0.25 weight percent of the aluminum charge enhancing additive (II) of Example I by blending in a small coffee blender for 30 to 60 seconds.

The above treated toner was equilibrated at room temperature under a 50 percent relative humidity condition for 24 hours. A developer was then prepared by blending 2.0 weight percent of the surface-treated toner with 98.0 weight percent of a carrier containing a nickel zinc ferrite core obtained from Steward Chemicals and 0.9 weight percent of a polymer composite coating comprised of 80 weight percent of a methyl terpolymer and 20 weight percent of VULCAN XC72™ carbon black. The methyl terpolymer is comprised of about 81 weight percent of polymethyl methacrylate and 19 weight percent of a styrene vinyltriethoxysilane polymer. The developer was roll milled for 30 minutes to generate the time zero developer, and the triboelectric charge of the toner of the resulting developer was measured to be −21.3 microcoulombs per gram by the standard blow-off technique in a Faraday Cage apparatus, To measure the rate of triboelectric charging of toner, 1.0 weight percent of the above uncharged toner was added to the time zero developer, and the charge distribution of the toner of the resulting developer was measured as a function of the blending time via roll milling using a charge spectrograph. The time required for the toner of the resulting developer to attain a charge distribution similar to that of the toner of the time zero developer was taken to be the rate of charging of the toner. For this toner, the rate of charging was 30 seconds.

EXAMPLE V

A black toner was prepared in accordance with the procedure of Example IV with the aluminum charge additive (III) of Example II in place of the aluminum charge additive of Example I. A developer was then prepared from this toner in accordance with the procedure of Example IV. The toner has a triboelectric charge of −18.5. microcoulombs per gram, and a rate of charging, or admix of about 15 seconds.

COMPARATIVE EXAMPLE (A)

A comparative black toner with the charge enhancing additive, BONTRON E-88® available from Orient Chemicals and believed to be tris(3,5-di-tertiary-butylsalicylato) aluminum, was prepared by blending the untreated toner of Example IV with 0.25 weight percent of BONTRON E-88®, and a developer was then prepared from this toner in accordance with the procedure of Example IV. The toner exhibited a triboelectric charge of −40.4 microcoulombs per gram, and its rate of charging was measured to be about 5 minutes.

COMPARATIVE EXAMPLE (B)

A second comparative black toner was prepared by blending the untreated toner (no charge additive) of Example IV with 0.25 weight percent of zinc(II) acetylacetonate of U.S. Pat. No. 5,409,794, and a developer was then prepared accordingly, and as illustrated above, reference Example IV. The toner exhibited a triboelectric charge of −11.6 microcoulombs per gram, and its rate of charging, or admix was about 120 seconds.

EXAMPLE VI

A black toner was prepared in accordance with the procedure of Example IV using zinc charge additive (X) of Example III instead of the aluminum charge additive of Example I. A developer was then prepared from this toner in accordance with the procedure of Example IV. The toner displayed a triboelectric charge of −23.4 microcoulombs per gram, and its rate of charging was measured to be less than 45 seconds, and in embodiments 30 seconds.

COMPARATIVE EXAMPLE (C)

A comparative black toner was prepared by blending the untreated toner of Example IV with 0.30 weight percent of copper (II) acetylacetonate of U.S. Pat. No. 5,409,794, and a developer was then prepared from this toner in accordance with the above processes, reference Example IV. The toner exhibited a triboelectric charge of −22.3 microcoulombs per gram, and its rate of charging, or admix was about 2 minutes.

EXAMPLE VII

A blue toner comprised of 95.0 weight percent of SPAR II™ polyester resin, 3.0 weight percent of PV FAST BLUE™ pigment, and 3.0 weight percent of aluminum charge enhancing additive (II) of Example I was prepared by melt blending these three components, followed by micronizing and classifying in accordance with the procedure of Example IV. The resulting toner had a volume average particle diameter of 8.7 microns, and a particle size distribution of 1.30. A developer was prepared from this toner by mixing 2.0 weight percent of toner and a carrier containing a steel core, and 0.8 weight percent of a polymer composite coating comprised of 80 weight percent of polymethyl methacrylate and 20 weight percent of VULCAN XC72™ carbon black. The toner displayed a triboelectric charge of −16.8 microcoulombs per gram, and its rate of charging was measured to be about 60 seconds.

The toner was then surface coated with 0.4 weight percent of AEROSIL R972® by conventional dry blending methods, and a developer was prepared with this toner and the above steel coated carrier particles as indicated herein. The triboelectric charge of this toner was measured to be −20.3 microcoulombs per gram, and its rate of charging, or admix was 30 seconds.

COMPARATIVE EXAMPLE (D)

A comparative blue toner and developer composition with the zinc(II) 3-phenyl-2,4-pentanedionate of U.S. Pat. No. 5,409,794 was prepared in accordance with the procedure of Example VII except that zinc(II) 3-phenyl-2,4-pentanedionate was utilized in place of the aluminum additive (II). The toner displayed a triboelectric charge of −9.3 microcoulombs per gram, and its rate of charging was about 3 minutes.

Other modifications of the present invention may occur to those skilled in the art subsequent to a review of the present application, and these modifications, including equivalents thereof, are intended to be included within the scope of the present invention.

What is claimed is:

1. A negatively charged toner composition comprised of thermoplastic resins, colorants, optional surface additives, and a metal charge enhancing additive of the formula (I)

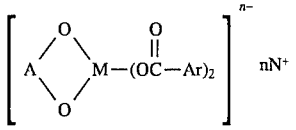

(I)

wherein M is zinc or aluminum; A is arylene; Ar is aryl; N+ is the countercation of an alkaline cation, and which countercation is K+, Li+, Na+, Cs+, or the ammonium ion; and n is the number 1 or 2.

2. A toner composition in accordance with claim 1 wherein N+ is Li+, Na+, K+, Cs+, $R_3NH$+, $R_2NH_2$+, $RNH_3$+, or $NH_4$+ wherein R is alkyl.

3. A toner composition in accordance with claim 1 wherein A is ortho-phenylene.

4. A toner composition in accordance with claim 3 wherein the phenylene moiety contains an alkyl substituent containing from 1 to about 10 carbon atoms.

5. A toner composition in accordance with claim 1 wherein A is alkylphenylene group, and Ar is alkylphenyl group with the alkyl group containing from 1 to about 10 carbon atoms, and N+ is K+, Na+, or Cs+.

6. A toner composition in accordance with claim 1 wherein the charge additive is present in an amount of from about 0.05 to about 5 weight percent.

7. A toner composition in accordance with claim 1 wherein the charge additive is present in an amount of from about 0.1 to about 3 weight percent.

8. A toner composition in accordance with claim 1 wherein the charge additive is incorporated into the toner, or wherein the charge additive is present on the surface of the toner.

9. A toner composition in accordance with claim 8 wherein the charge additive is contained on colloidal silica particles present on the surface of the toner.

10. A toner composition in accordance with claim 1 wherein the toner's rate of charging is less than about 60 seconds when charging is accomplished by friction against carrier particles via roll milling.

11. A toner composition in accordance with claim 1 with a negative triboelectric charge of from between about −10 to about −40 microcoulombs per gram.

12. A toner composition in accordance with claim 1 wherein the resin is comprised of styrene acrylates, styrene methacrylates, styrene butadienes, or polyesters.

13. A toner composition in accordance with claim 1 further containing a wax component with a weight average molecular weight of from about 1,000 to about 7,000.

14. A toner composition in accordance with claim 13 wherein the wax component is selected from the group consisting of polyethylene and polypropylene.

15. A toner composition in accordance with claim 1 wherein the surface additives are metal salts of a fatty acid, colloidal silicas, or mixtures thereof.

16. A toner composition in accordance with claim 1 wherein the colorants are pigments selected from the group consisting of carbon black, magnetites, cyan, magenta, yellow, red, blue, green, brown, and mixtures thereof.

17. A developer composition comprised of the toner composition of claim 1 and carrier particles.

18. A developer composition in accordance with claim 17 wherein the carrier particles are comprised of ferrites, steel, or an iron powder with an optional polymer, or mixture of polymer, coating thereover.

19. A developer composition in accordance with claim 18 wherein the coating is comprised of a methyl terpolymer of styrene, butylmethacrylate and triethoxy vinyl silane, a polyvinylidine fluoride, or a polymethyl methacrylate.

20. A toner in accordance with claim 1 wherein M is zinc, A is aromatic with from 6 to about 24 carbon atoms, Ar is aromatic with from 6 to about 24 carbon atoms, N+ is the countercation of an alkaline cation, and which countercation is K+, Li+, Na+, Cs+, or the ammonium ion; and n is the number 1 or 2.

21. A toner in accordance with claim 1 wherein M is aluminum, A is aromatic with from 6 to about 24 carbon atoms, Ar is aromatic with from 6 to about 24 carbon atoms, N+ is the countercation of an alkaline cation, and which countercation is K+, Li+, Na+, Cs+, or the ammonium ion; and n is the number 1 or 2.

22. A toner in accordance with claim 1 wherein n is 1.

23. A toner in accordance with claim 1 wherein the charge enhancing additive is selected from the group consisting of compounds of the formulas

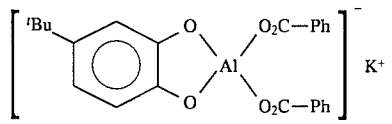

(II)

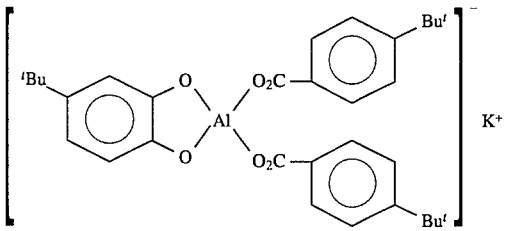

(III)

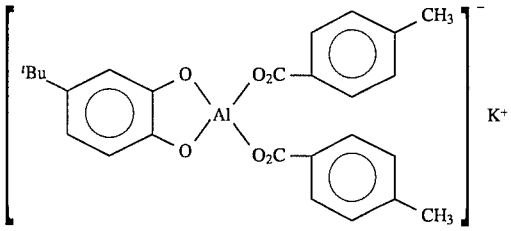

(IV)

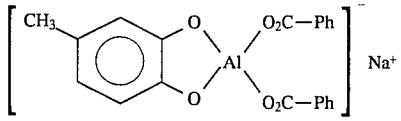

(V)

-continued
(VI)
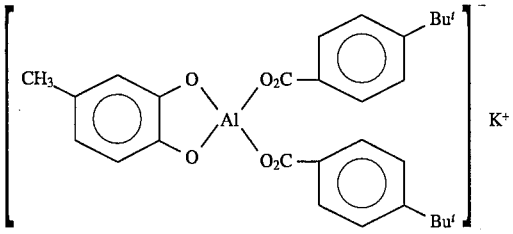
(VII)
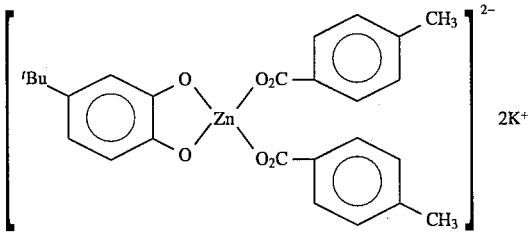
(VIII)
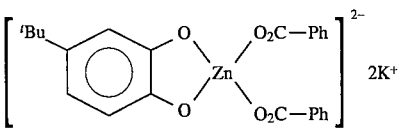
-continued
(IX)
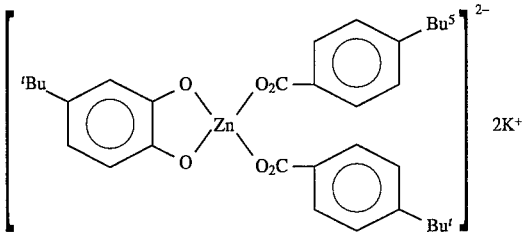
(X)
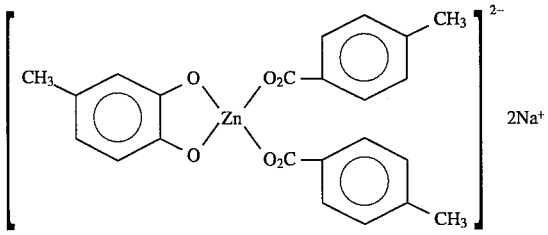
* * * * *